US007913521B2

(12) United States Patent
Lonati

(10) Patent No.: US 7,913,521 B2
(45) Date of Patent: Mar. 29, 2011

(54) CONNECTION DEVICE FOR PIEZOELECTRIC ACTUATORS OF JACQUARD BARS OF KNITTING MACHINES

(75) Inventor: Tiberio Lonati, Brescia (IT)

(73) Assignee: Santoni S.P.A., Brescia (IT)

( * ) Notice: Subject to any disclaimer, the term of this patent is extended or adjusted under 35 U.S.C. 154(b) by 0 days.

(21) Appl. No.: 12/625,961

(22) Filed: Nov. 25, 2009

(65) Prior Publication Data

US 2010/0126231 A1 May 27, 2010

(30) Foreign Application Priority Data

Nov. 26, 2008 (IT) ..... BS2008A0220

(51) Int. Cl.
*D04B 27/24* (2006.01)

(52) U.S. Cl. ..... 66/205; 66/207

(58) Field of Classification Search ..... 66/205, 66/203, 204, 207, 218–220
See application file for complete search history.

(56) References Cited

U.S. PATENT DOCUMENTS

| | | | | |
|---|---|---|---|---|
| 5,390,512 | A * | 2/1995 | Mista | 66/205 |
| 5,491,988 | A * | 2/1996 | Hohne et al. | 66/204 |
| 5,533,366 | A * | 7/1996 | Mista et al. | 66/205 |
| 5,542,270 | A * | 8/1996 | Mista et al. | 66/207 |
| 5,553,470 | A * | 9/1996 | Hohne et al. | 66/205 |
| 5,561,989 | A * | 10/1996 | Mista | 66/205 |
| 5,918,485 | A * | 7/1999 | Fischer et al. | 66/205 |
| 6,293,315 | B1 * | 9/2001 | Froment et al. | 139/55.1 |
| 6,357,486 | B2 * | 3/2002 | Braun | 139/59 |
| 7,607,324 | B2 * | 10/2009 | Lonati | 66/205 |
| 2009/0107184 | A1 * | 4/2009 | Lonati | 66/205 |
| 2010/0126230 | A1 * | 5/2010 | Lonati | 66/205 |
| 2010/0126231 | A1 * | 5/2010 | Lonati | 66/205 |
| 2010/0126232 | A1 * | 5/2010 | Lonati | 66/214 |

FOREIGN PATENT DOCUMENTS

| | | | |
|---|---|---|---|
| DE | 42 26 899 | C1 | 1/1994 |
| DE | 19613385 | A1 | 10/1997 |
| DE | 202006007428 | U1 | 2/2007 |
| JP | 63 092762 | A | 4/1988 |

* cited by examiner

*Primary Examiner* — Danny Worrell
(74) *Attorney, Agent, or Firm* — Pearne & Gordon LLP

(57) ABSTRACT

A connection device (4) for piezoelectric actuators (3) of jacquard bars for textile machines, comprising a bearing body (32), a plurality of interconnection elements (34) inserted into the bearing body (32), which can be removably connected to a corresponding plurality of interface electric contacts (9) of a plurality of piezoelectric actuators (3), at least one interconnection terminal (33) for the interconnection elements (34) with control means of a textile machine, and at least one fastening portion (35) configured and arranged so as to removably mount the bearing body (32) onto a supporting body (7) of a jacquard thread-guide bar (2).

21 Claims, 10 Drawing Sheets

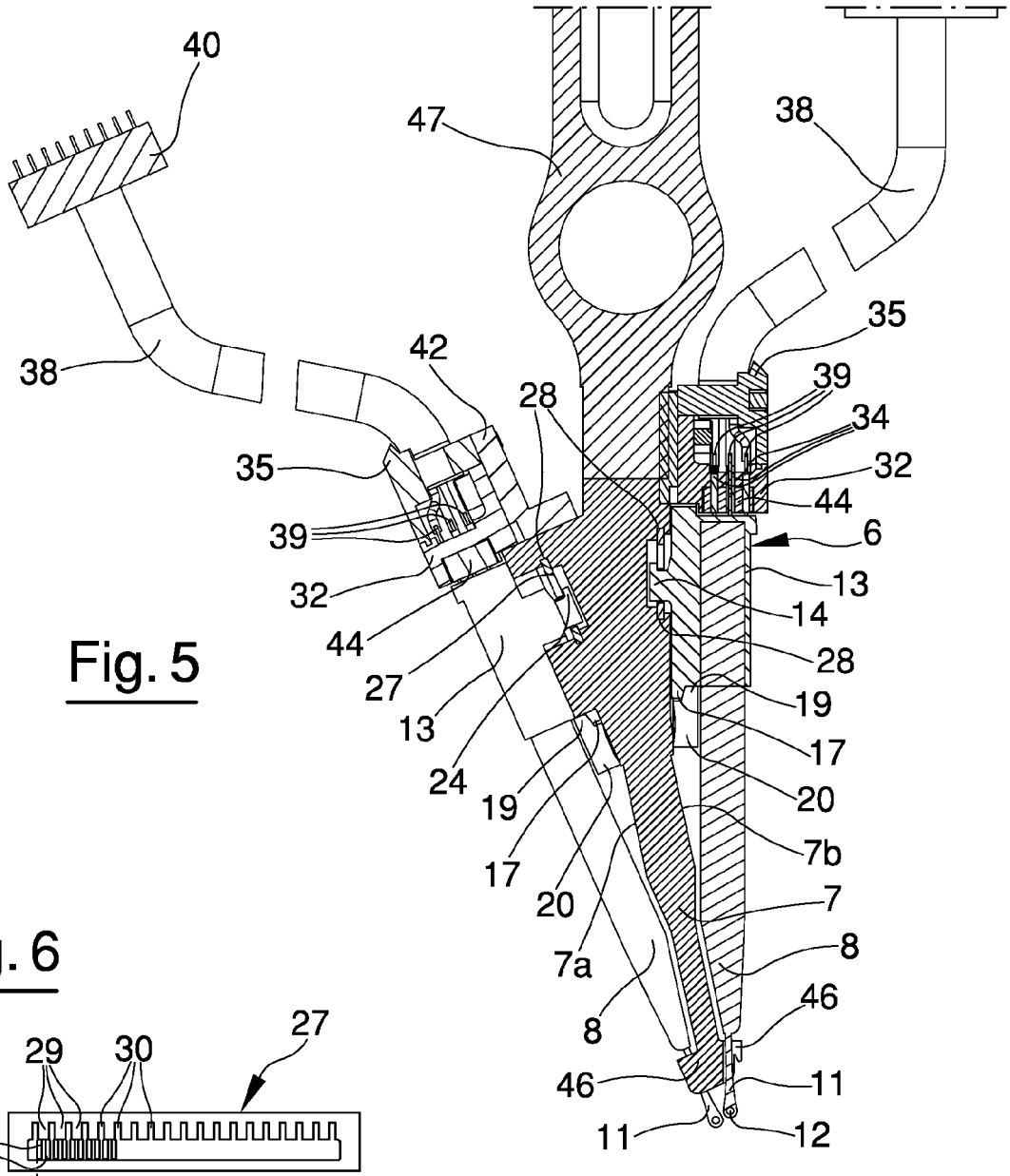
Fig. 5
Fig. 6
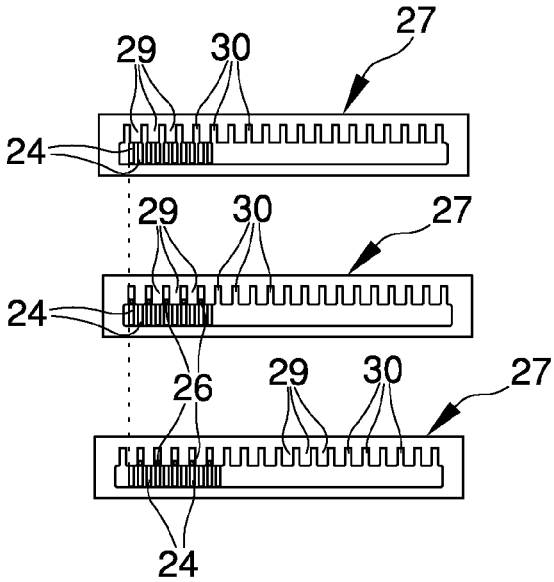
Fig. 6a
Fig. 6b

Fig. 7
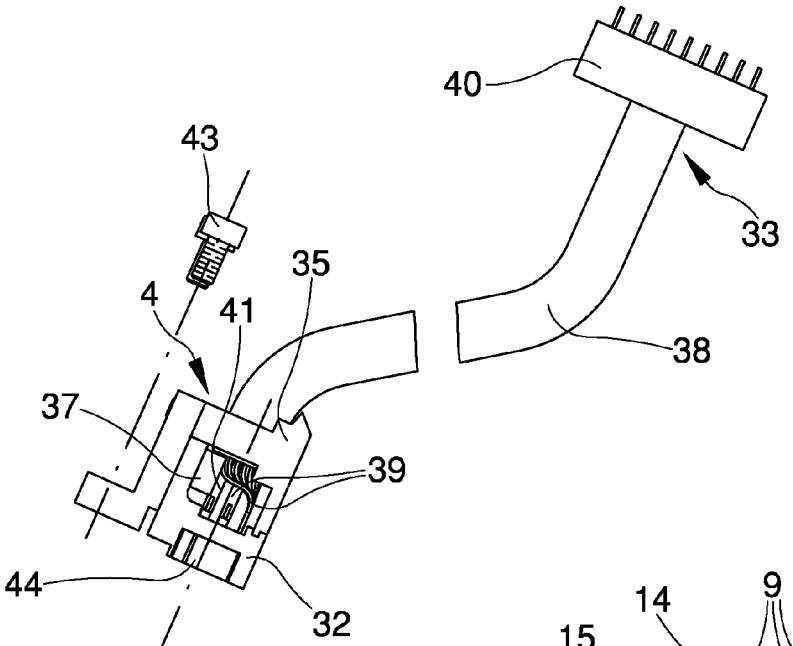
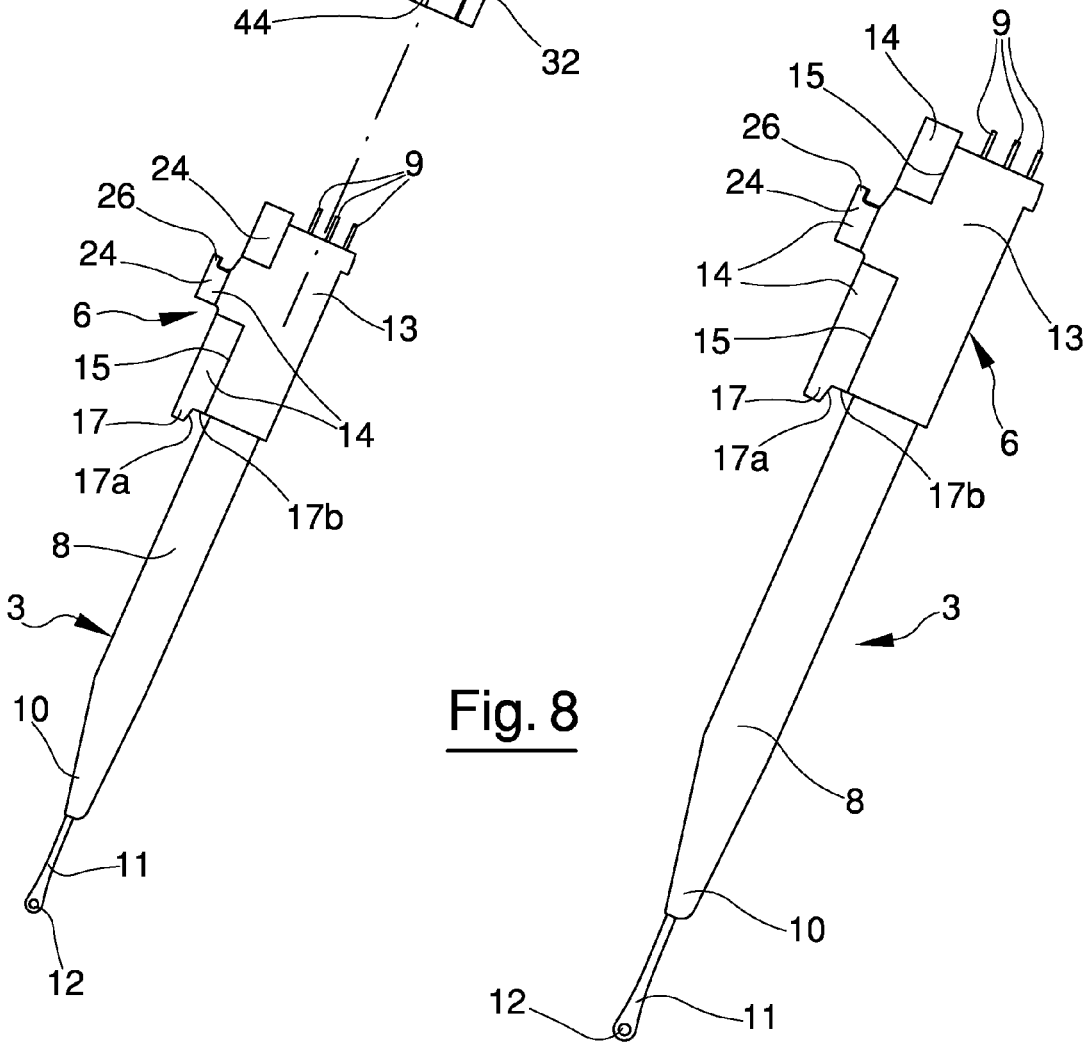
Fig. 8

Fig. 9a
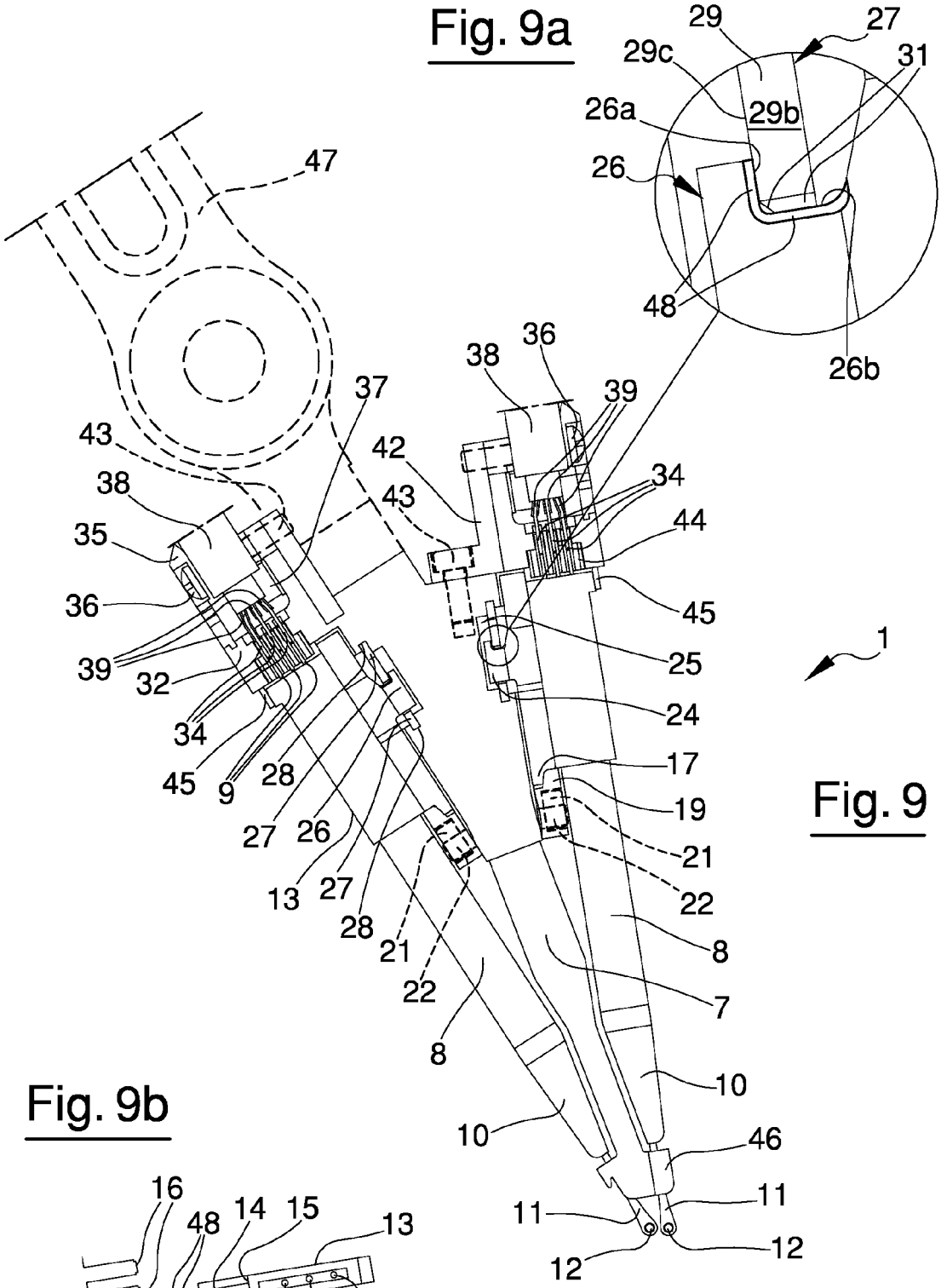
Fig. 9
Fig. 9b
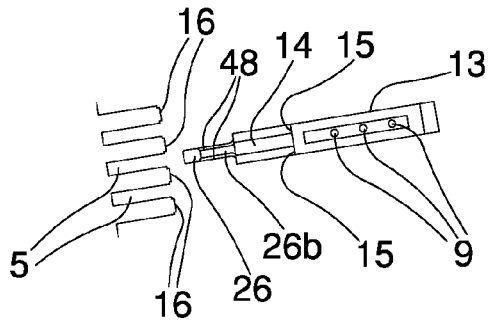

CONNECTION DEVICE FOR PIEZOELECTRIC ACTUATORS OF JACQUARD BARS OF KNITTING MACHINES

The present invention relates to connection device for piezoelectric actuators of jacquard bars for textile machines, in particular for warp knitting machines such as warp, raschel, tricot, crochet looms and similar families. The present invention further relates to a warp knitting machine comprising the aforesaid device. As is known, linear warp knitting machines are provided with a plurality of bars designed to carry a plurality of thread-holding elements, commonly known as thread-guides. Such bars are moved so as to enable the threads associated with the thread-guides to be correctly fed onto the needles of a needle bed of the knitting machine for the formation of new fabric. The thread-guide bar makes two basic movements, a linear movement in front of or behind the hook of each needle, commonly known as "shog", and an oscillating movement on the side of each needle for bringing the threads alternatively before and behind the needle hook, commonly known as "swing". Furthermore, it is known about jacquard-type thread-guide bars, which are provided with jacquard devices enabling to move each thread-guide individually of an additional needle space, in the same or opposite direction with respect to the shog movement of said bars, according to a specific pattern to be obtained in the fabric. To this purpose two types of selection are basically still in use today, one making use of piezoelectric or piezoceramic elements, the other one making use of a pull-and-push system for mechanical elements which are able to shift the thread-guide from one position to the other. In the first case, the shift occurs by deflection or bending of a sheet, which is stiffly anchored in its upper portion and can freely move upon control in its lower portion. The lower movement occurs between two mechanical stops whose space is stiffly defined as a function of the machine fineness. The tip or end of the bending sheet has a hole through which the weaving thread is led. With the shift of the lower end of the sheet, i.e. the thread-guide portion, the thread therein is also shifted and interacts with the underlying needle.

A selective shift of the thread-guide bars involves an individual shift of the thread between two adjacent needles, so that during weaving the thread for a needle can be selectively shifted onto the adjacent needle, i.e. forward or backward of a needle shed with respect to its original position. The additional shift is always of one needle in jacquard machines. Patent JP63092762 dated 30 Sep. 1986 introduced the use of piezoelectric elements associated with individual thread-guides for the formation of jacquard fabrics on warp knitting machines. According to this patent, the shifts of the piezoelectric elements can be made at any time and at a higher speed with respect to traditional mechanical systems, thus both when the thread-guide is before the needle hook (movement referred to as "overlap") and when it lies behind the needle hook (movement referred to as "underlap"), or when due to the shift of the bar (horizontal translation of the bar or shog), the latter shifts horizontally in both directions.

Then, together with the development of technology in electronics and in the piloting field, of new materials for electric cables and the like, of new systems of electronic integrated circuits for sending selective electric signals to the various terminals or pins connected to piezoelectric sheets of jacquard actuators, alternative solutions were developed, which indeed exploited the new inventions provided by the electronic industry in general. As far as circuitry is concerned, i.e. number of cables and size thereof, huge improvements were obtained by exploiting in particular the technology of data conversion from serial to parallel, so as to selectively send to individual pins currents and voltages required for shifting or bending the piezoelectric thread-holding sheet. Commands are no longer sent by a multitude of wires connected to the single pins (such as e.g. in patent DE4226899 of Aug. 14, 1992) but with buses, data "travel" on few wires serving a number or group of sheets depending on the integrated circuits used. For instance, the technology known as SPI (Serial Parallel Interface) is today a standard in this respect. This system refers to a serial-to-parallel conversion interface for signals (which are present on the transmission bus and are used for controlling the piezoelectric sheets in jacquard systems). This interface has been known and standardized for a long time (indeed, it dates back to the early Eighties). There are many other bus-based data transmission systems like SPI, which are enhanced and safer with respect to old SPI, but basically their function is the same, i.e. if a weak signal is present on the bus, a power section/card is enabled, which will supply the energy required for a proper operation of the actuator as programmed. Typically, in electronics numbers are expressed on a hexadecimal basis and accordingly the optimal solution is to distribute commands on groups made up of 16 threads. Still exploiting this electronic peculiarity, selectors for jacquard actuators using modules made up of 16 actuators were developed. An example of such systems is disclosed in U.S. Pat. No. 5,533,366. Said modules physically carry 16 actuators firmly fastened to each module, and the module is then mounted onto the jacquard bar. Beyond being physically connected to the module, generally glued thereto, the actuators are stiffly connected to the various wires connecting to their pins by welding, the wires welded to the various pins are gathered and led through a structure (extruded cable made of normal or heat-shrinking rubber or tubular knitted sheath), all the wires from the actuator-holding module, gathered in an outer cable or sheath, are led to a connector (generally a male connector) which will be fitted into a female connector being part of an interface for transmitting power signals to the single pins of the electric actuators. Such interface connects the actuator-holding modules to the power side, which supplies current and voltage and is controlled by a microprocessor-based control system reacting to the commands sent by the program generating the knitting structures and thus the shifts of the piezoelectric sheets. This is one structure made up of a module stiffly incorporating the piezoelectric sheets by gluing with a suitable resin the pins of the single piezoelectric sheets to the electric wires stiffly connected thereto, e.g. welded thereto. This area is in its turn coated with resin and makes one piece of the wire cables, of the sheet pins and of the sheets in the welding area, so as to prevent vibrations undergone by the piezoelectric module during operation from causing the total or partial separation of the welding from the pin of the piezoelectric sheet, which would damage it irretrievably and produce a failed reject. In the case of a problem on a given damaged piezoelectric sheet, which is part of a given group or module, this solution enables a relatively rapid replacement of a module with a working spare one. However, this system has some important drawbacks as described below. First of all, in the presence of a single failed piezoelectric actuator, the whole group (generally made up of 16 actuators) should be replaced, which thus means having spare groups, obviously with the same machine fineness. Spare stocks cannot include few modules since the machine (e.g. a machine with a length of 3.5 m) is equipped with many of these modules, i.e. about 400 pieces. Moreover, modules are quite expensive, which thus considerably increases the costs for the replacement of a single actuator. Furthermore, considering the stock made up of a reasonable number of modules (at least ten), the total expense is very high. For a failed piezoelectric actuator, therefore, a whole module comprising 16 actuators (15 of them correctly operating) and further comprising connecting cables and connectors should be replaced.

Another drawback consists in that module replacement requires time, i.e. downtime, no production and more or less rejects of manufactured fabric. The reason is that the modules carrying the piezoelectric sheets are fitted into or fastened to a bar, one beside the other. Removing a module creates a void into which the new module will be fitted. However, although well built, the modules are not all identical and perfectly interchangeable due to manufacturing tolerances. In order to achieve that in a bar carrying e.g. 100 modules the first and the last thread-guide perfectly match the first and the last needle, the single module is made with a slightly smaller width than the theoretical value, so as to enable under any circumstance the introduction of a new module between two neighboring modules. Manufacturing tolerances for the single modules are quite accurate, but variations even of few hundredths of millimeter can eventually result in a high variation, e.g. a tolerance per module of 0.02 mm×50 modules=1 mm, in other words the last thread-guide sheet will be misaligned with respect to its needle of 1 mm. Considering a machine with fineness 24, i.e. a machine with 24 needles per inch (corresponding to 25.4 mm), the shed between one needle and the other is of 25.4:24=1.0583 mm, in other words with said shift of 1 mm the last thread-guide might be aligned with or match not its own needle, but the previous one. Accordingly, the single modules should be placed in position one by one, so that the thread-guides perfectly match their needles. This is a typically manual operation carried out by specialized personnel, first on a bench by comparing the positions of the single sheets with a specimen needle bed, i.e. suitable mounting and calibration equipment. If the module is not OK, the module body is modified laterally with small adjustments involving metal removal and thus size variation, so that locations are complied with. Thus, by removing material on the right or left of the module the theoretical space between the two modules increases. Therefore, inevitably, the modules do not get in contact but after mounting create a clearance, which remains and makes the replacement of a failed module with a working one more difficult. The replacement of a module is therefore critical, since when replacing a module there are no visual location elements between the piezoelectric sheets and the needles. The module is mounted and then has to be adjusted, altered, aligned, so that it complies with working conditions. If the module is not OK, it should be removed and modified by removing material on the left or right, if it is misaligned or if the space left by the module once removed is too large and therefore with a considerable clearance of about 0.15-0.30 mm, the person charged with maintenance should find a solution so as to place it in the correct position by adjusting it with simple means, e.g. a screwdriver, by levering up on the module nearby so as to shift it roughly and then fastening it in the assumed correct position, which should anyhow be checked during weaving. This operation is complex, may require several attempts and should be carried out accurately so as not to jeopardize the function of the machine and the quality of the manufactured products. More to the point, it should be kept in mind that during replacement 16 threads of the machine should be unthreaded and in the end still 16 threads should be re-threaded, in quite uncomfortable positions. Therefore, beyond the cost for the module to be replaced, the replacement operation is complex and requires specialized personnel. Finally, the known technique involves a great time waste for the replacement of each actuator (if no specialized technician is present when the failure occurs, the machine might be out of order for a long time), with sometimes important drawbacks as far as production levels are concerned. Moreover, the module cannot be repaired by the weaving firm and as a rule it is sent to the manufacturer, where often it is not repaired either. As a matter of fact, repair involves the removal and replacement of a single piezoelectric sheet, which—as was said—is sealed by resin or glue with all the other module portions, with the connections of the electric wires, with the other sheets etc. Resin removal is carried out in hot conditions, with subsequent problems involving handling of the melted resin, which should be accurately removed, and above all with frequent damages to the protections of the small electric cables, which can leave part of the copper conductive wire uncovered. It is therefore necessary to cut and re-weld every single pin of the piezoelectric sheet or then increase the area to be coated with resin, thus creating a difficult situation. Moreover, hot resin removal often involves damages to the fragile sheet walls on which the ceramic portions forming the capacitors—the core of the operation of piezoelectric sheets—are applied by deposition, and therefore repaired modules are often no longer reliable as required. Thus, repairs are so complex and uncertain that it is often not worth repairing the module, and a module with one failed piezoelectric element only and 15 working modules is often rejected. Eventually, it should be pointed out that warp knitting machines with one or two needle beds use piezoelectric modules applied onto two distinct jacquard bars for each needle bed (a jacquard bar carries the thread-guides for even needles, the other one the thread-guides for odd needles), and therefore there is a large number of modules in the machine.

The aim of the present invention is to overcome the limitations of known technique by proposing a connection device for piezoelectric actuators of jacquard bars for textile machines which is not affected by the drawbacks as described. Another aim of the present invention is to provide a connection device for piezoelectric actuators of jacquard bars for textile machines with a simple structure, which is easy to carry out and/or with relatively low costs. A further aim of the present invention is to enable a simple, rapid and cheap replacement of failed piezoelectric actuators, without complex technical interventions or adjustments and without damaging un-replaced actuators. A further aim of the present invention is to reduce downtime, problems involving maintenance and replacement of piezoelectric actuators and also to reduce spare stocks required to ensure a continuous operation of the textile machine. Another aim of the invention is to reduce costs for management, stocks and maintenance of a warp knitting textile machine. A further aim of the invention is to show a warp knitting textile machine which is robust, reliable, easy to use and to maintain. These and other aims, which will be more readily apparent from the following description, are achieved according to the present invention by a connection device for piezoelectric actuators of jacquard bars for textile machines in accordance with the appended claims.

In another aspect, the invention further relates to a connection device further comprising at least one working portion apt to act, with the connection device on the jacquard thread-guide bar in mounting position, upon the plurality of actuators mounted directly on the supporting body of the jacquard thread-guide bar so as to keep said actuators in mounting position on the jacquard thread-guide bar. In another aspect, the invention further relates to a connection device in which the working portion is apt to act upon a mounting body of the actuators so as to keep said mounting body inside a housing seat of the supporting body of the jacquard thread-guide bar and in contact with a holding portion of the jacquard thread-guide bar. In another aspect, the invention further relates to a connection device in which the interconnection elements further comprise a plurality of male connectors, operatively interposed between the plurality of female connectors and the connection wires. In another aspect, the invention further relates to a connection device in which said female connectors are housed inside a secondary body which can be operatively inserted into the bearing body. In another aspect, the invention further relates to a connection device further comprising at least one pushing element apt to act, with the connection device on the jacquard thread-guide bar in mounting position, upon the plurality of actuators so as to keep the latter in position against the jacquard thread-guide bar, the pushing element being configured so as to exert onto the actuators a force acting in a direction transversal to the direction in which acts a force exerted onto the actuators by the working portion. In another aspect, the invention further relates to a connection device in which the pushing element is of elastic type and is apt to bend when the connection device is associated with each actuator so as to exert an elastic thrust onto the plurality of actuators for keeping them in position against the jacquard thread-guide bar in mounting position.

In a further aspect, the invention further relates to a piezoelectric actuator for jacquard thread-guide bars of warp knitting textile machines, comprising a mounting body singularly dedicated to the piezoelectric actuator and onto which a single piezoelectric body is mounted; the piezoelectric body, a plurality of interface electric contacts operatively connected to the piezoelectric body, and a connecting portion apt to interface with a thread-guide portion, the mounting body being configured and predisposed so as to be able to be removably engaged into a housing seat of a supporting body of a jacquard bar and to carry out an individual and removable mounting of the actuator onto the supporting body. In another aspect, the invention further relates to an actuator in which the mounting body is configured and predisposed so as to be to be able to be slidingly engaged in a guided manner into the housing seat of the supporting body, between a mounting position and a disengaged position. In another aspect, the invention relates to an actuator in which the mounting body further protrudes transversally to the longitudinal extension of the piezoelectric body into a lying plane of the piezoelectric body and/or in which the mounting body extends longitudinally along at least a part of the longitudinal extension of the piezoelectric body.

In another aspect, the invention further relates to an actuator in which the mounting body comprises at least one bearing portion on, or in, whose at least one portion a part of the piezoelectric body is housed. In another aspect, the invention further relates to an actuator in which the mounting body comprises at least one inserting portion which can be slidingly engaged in a guided manner into the housing seat of the supporting body, the inserting portion being thinned, with a thickness, corresponding to the width of the housing seat in which the inserting portion is configured so as to be inserted, smaller than the corresponding thickness of the bearing portion.

In another aspect, the invention further relates to an actuator in which the bearing portion of the mounting body is provided with a plurality of rest areas apt to cooperate with suitable prop areas of the supporting body, with the actuator mounted onto the supporting body and the inserting portion inserted into the housing seat. In another aspect, the invention further relates to an actuator in which the mounting body comprises at least a first hooking portion configured so as to cooperate with a holding seat defined by a holding portion of the supporting body. In another aspect, the invention further relates to an actuator in which the first hooking portion is provided with a surface inclined with respect to the longitudinal extension of the piezoelectric body and configured so as to cooperate with a corresponding inclined surface of the holding portion of the supporting body for pushing the piezoelectric actuator toward the supporting body.

In another aspect, the invention further relates to an actuator in which the mounting body comprises at least a second hooking portion having a shape apt to be removably engageable into a corresponding hooking seat of the supporting body. In another aspect, the invention further relates to an actuator in which the second hooking portion has a shape apt to be hooked into the corresponding hooking seat.

In another aspect, the invention further relates to an actuator in which the mounting body comprises, with relation to the hooking seat, a rest portion configured so as to cooperate with a blocking element of the supporting body for keeping the second hooking portion within the corresponding hooking seat. In another aspect, the invention further relates to an actuator in which the bearing portion of the mounting body has a thickness basically corresponding to the shed of a plurality of said housing seats in the supporting body, so that a plurality of actuators mounted into the plurality of housing seats have their bearing portions adjacent to one another and basically in contact one with the other.

In another aspect, the invention further relates to a device for jacquard selection in warp knitting textile machines, comprising at least one jacquard thread-guide bar comprising a supporting body provided with a plurality of housing seats, each configured and predisposed so as to engage removably and singularly the mounting body and carry out a removable mounting of the piezoelectric actuator onto said supporting body; and a plurality of piezoelectric actuators, each of them being singularly mounted into one of said housing seats.

In another aspect, the invention relates to a piezoelectric actuator for jacquard thread-guide bars in which rest areas are obtained on connection points between a bearing portion and an inserting portion and defined by a smaller thickness of the inserting portion with respect to the bearing portion. In another aspect, the invention further relates to an actuator in which an inserting portion comprises an insert or basically laminar element inserted into the bearing body. In another aspect, the invention further relates to an actuator comprising three interface electric contacts protruding from a longitudinal end of a mounting body parallel to the longitudinal extension of a piezoelectric body. In another aspect, the invention further relates to an actuator further comprising a thread-guide portion provided with a through opening for a thread and mounted onto a connecting portion. In another aspect, the invention further relates to a group of actuators in which each one of the actuators is provided with a mounting body singularly dedicated to the piezoelectric actuator, which body can be singularly and individually mounted in a removable manner onto a corresponding housing seat of a supporting body.

In another aspect, the invention further relates to a jacquard thread-guide bar for warp knitting textile machines comprising a supporting body provided with a plurality of housing seats configured and predisposed so as to each removably engage a mounting body of a single piezoelectric actuator and carry out an individual, removable mounting of the single piezoelectric actuator onto said supporting body. In another aspect, the invention further relates to a bar in which the housing seats are configured and predisposed so as to guide the sliding of the mounting body, between a mounting position and a disengaged position. In another aspect, the invention further relates to a bar in which the housing seats extend perpendicularly to the main longitudinal extension of the bar. In another aspect, the invention further relates to a bar in which the supporting body has a front face and a rear face extending in respective directions parallel to the main longitudinal extension of said supporting body, the front face and the rear face being provided each with a corresponding plurality of housing seats, the housing seats of the front face being offset with respect to the housing seats of said rear face of a needle shed, so as to be able to lie on even and odd needles of a needle bed, respectively.

In another aspect, the invention further relates to a bar further comprising, near the housing seats, at least one holding portion defining a holding seat and configured so as to act upon a first hooking portion of the mounting body in order to keep the mounting body of a plurality of piezoelectric actuators in contact with the supporting body when the piezoelectric actuators are mounted onto the thread-guide bar. In another aspect, the invention further relates to a bar in which the holding portion defines a surface inclined with respect to the direction of longitudinal development of the housing seats so as to push the first hooking portion of the mounting body towards the supporting body. In another aspect, the invention further relates to a bar further comprising a holding element mounted onto the supporting body and defining the holding portion. In another aspect, the invention further relates to a bar further comprising mounting means for the holding element onto the supporting body, fine-adjustment elements for the adjustment of the position of the holding portion with respect to the supporting body, and fastening means for fastening to the supporting body apt to fasten unremovably the holding element to the supporting body after a fine adjustment of the position of the holding element by means of the fine-adjustment elements.

In another aspect, the invention further relates to a bar in which the supporting body further comprises a hooking seat configured so as to house a second hooking portion of the mounting body. In another aspect, the invention further relates to a bar further comprising a blocking element movable between at least a first operating position in which it is apt to act upon a rest portion of the mounting body so as to keep the second hooking portion in the hooking seat and the piezoelectric actuator mounted on the bar, and a second operating position in which it is apt not to act upon the rest portion and to enable the second hooking portion to be taken out of the hooking seat and the piezoelectric actuator to be removed from the bar. In another aspect, the invention further relates to a bar in which the blocking element is provided with a plurality of holding projections apt to act upon the rest portions, and with a plurality of recesses alternated to the holding projections, the recesses being apt to let the rest portions move.

In another aspect, the invention further relates to a bar in which the blocking elements can be moved between at least three operating positions, a first position in which it is apt to act upon all the rest portions of all the piezoelectric actuators mounted onto the supporting body so as to keep all the second hooking portions in their respective hooking seats, a second operating position in which it is apt to act upon a first sub-group of rest portions of a first sub-group of piezoelectric actuators mounted onto the supporting body and not to act upon a second sub-group of rest portions of a second sub-group of piezoelectric actuators mounted onto the supporting body, thus enabling the corresponding second hooking portions to be taken out of the corresponding hooking seats and the second sub-group of piezoelectric actuators to be dismounted from the supporting body, and a third operating position in which it is apt to act upon the second sub-group of rest portions of the second sub-group of piezoelectric actuators mounted onto the supporting body and not to act upon the first sub-group of rest portions of the first sub-group of piezoelectric actuators mounted onto the supporting body, thus enabling the corresponding second hooking portions to be taken out of the corresponding hooking seats and the first sub-group of piezoelectric actuators to be dismounted from the supporting body. In another aspect, the invention further relates to a bar in which the first sub-group and the second sub-group of rest portions comprise all the rest portions mounted on the bar, the first sub-group comprising even rest portions and the second sub-group odd rest portions. In another aspect, the invention further relates to a bar in which the blocking element is mounted onto the supporting body in a mobile manner, so as to move between the aforesaid operating positions. In another aspect, the invention further relates to a bar in which the blocking element is mounted in a sliding manner into a sliding seat obtained in the supporting body, so as to shift between the operating positions.

In another aspect, the invention further relates to a device for jacquard selection in warp knitting textile machines, comprising at least one jacquard thread-guide bar and a plurality of piezoelectric actuators comprising each a mounting body singularly dedicated to the piezoelectric actuator and onto which a single piezoelectric body is mounted, each mounting body being engaged into a respective seat of the said housing seats in an individually removable manner. In another aspect, the invention further relates to a bar in which the housing seats and/or the hooking seat are obtained by making cuts or grooves in the supporting body. In another aspect, the invention further relates to a bar in which the supporting body is the main structural bearing part of the jacquard thread-guide bar.

Further characteristics and advantages of the invention will be more readily apparent from the exemplary and non-limiting description of some preferred, though not exclusive, embodiments of a device for jacquard selection in a warp knitting textile machine comprising the invention and disclosed in the following drawings, in which.

Figure 1:
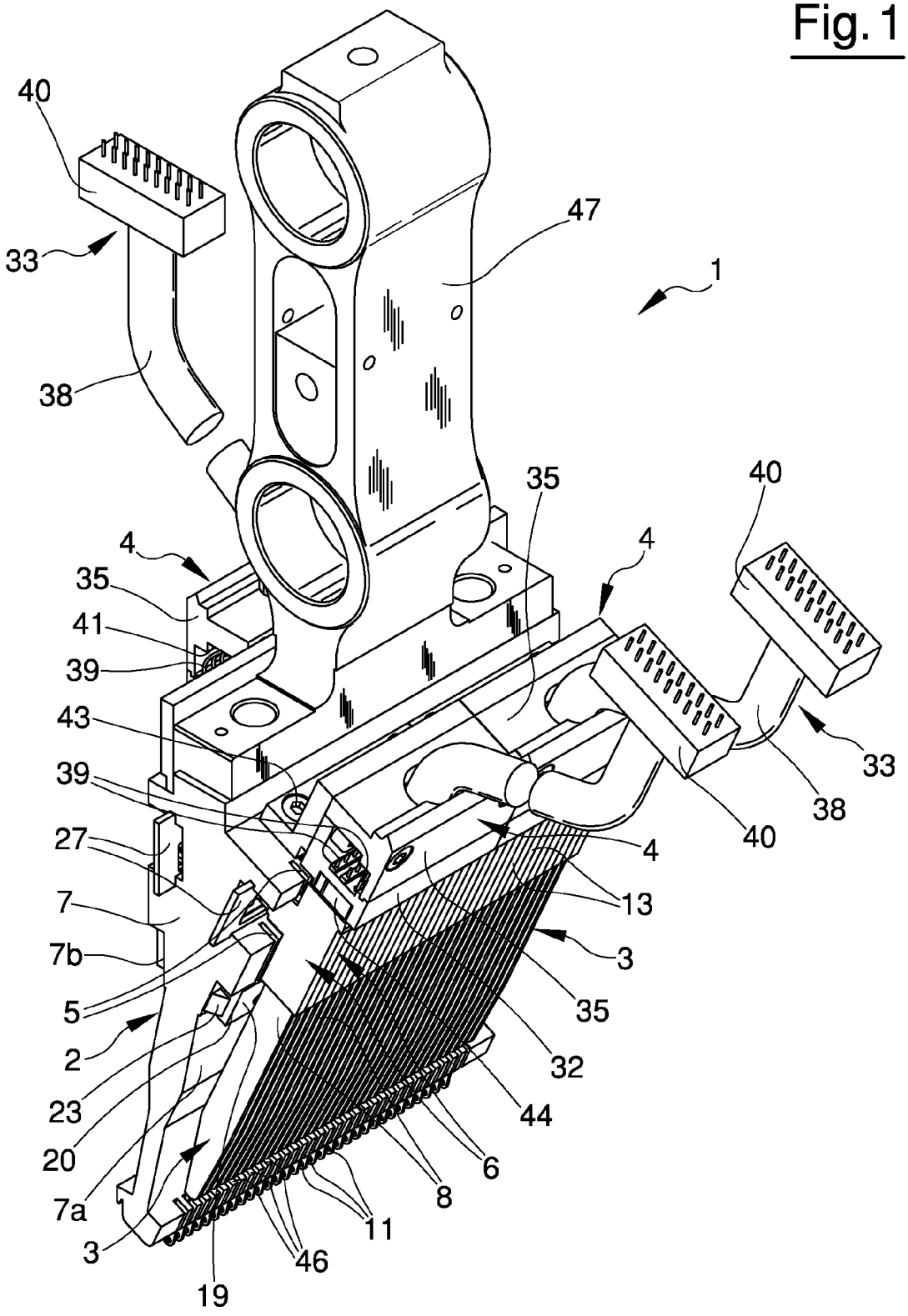
FIG. 1 shows a perspective view of a device for jacquard selection in a warp knitting textile machine, comprising a jacquard bar, a plurality of piezoelectric actuators and a plurality of connection devices, according to the present invention.
Figure 2:
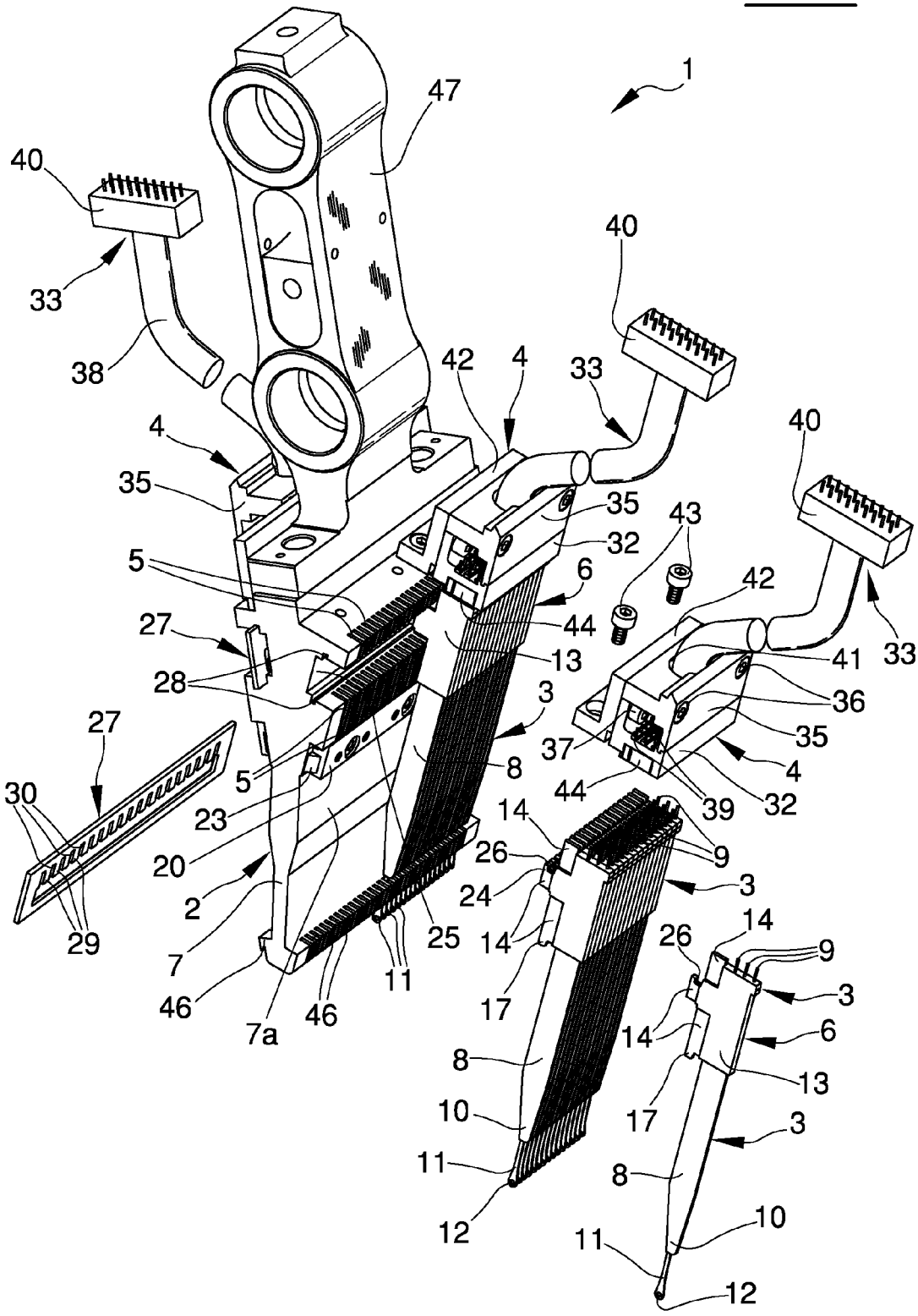
FIG. 2 shows a perspective view, partially exploded, of the device of FIG. 1, with some piezoelectric actuators, a blocking element and a connection device removed from the device of FIG. 1.
Figure 3:
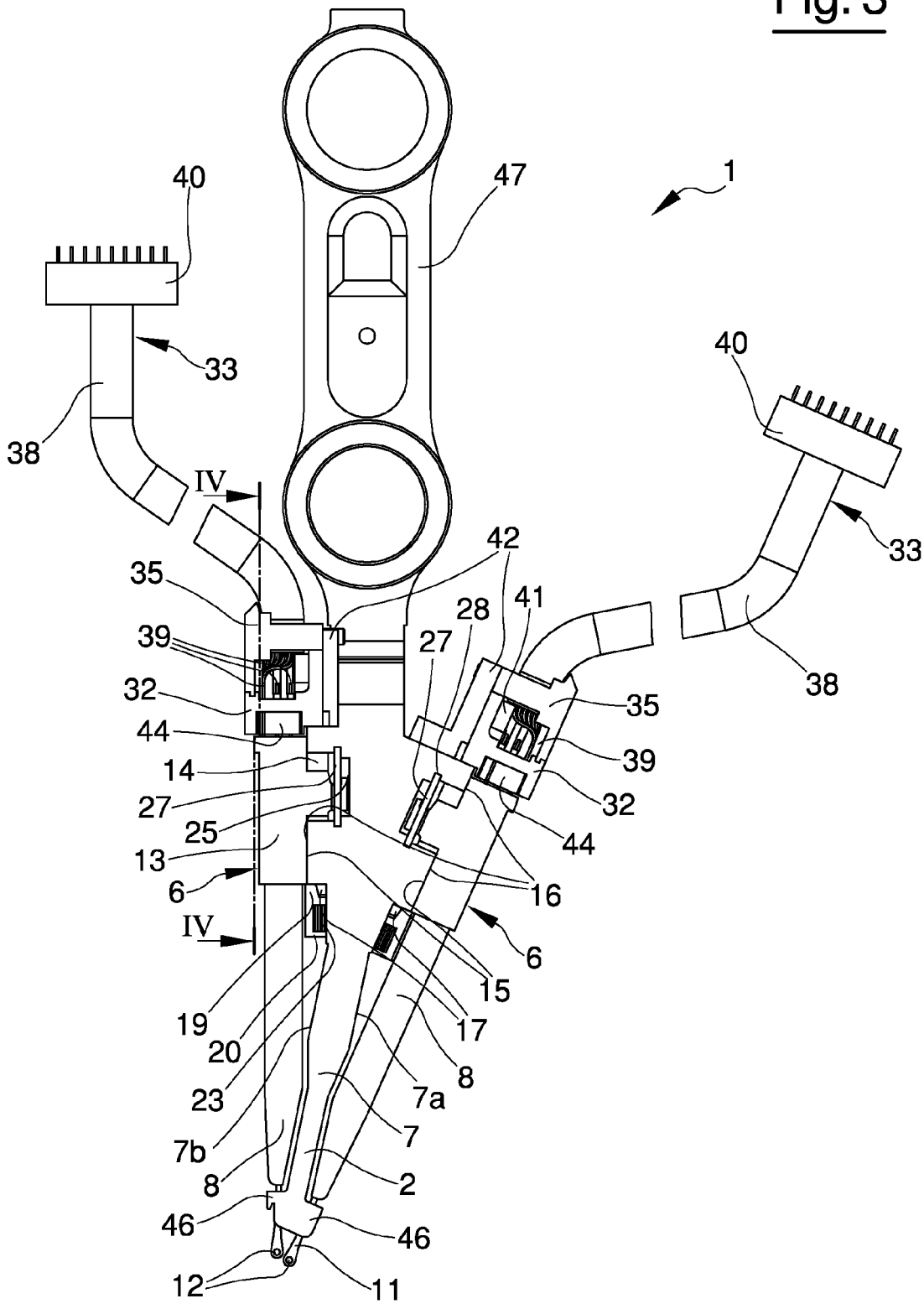
FIG. 3 is a side view of the device of FIG. 1.
Figure 4:
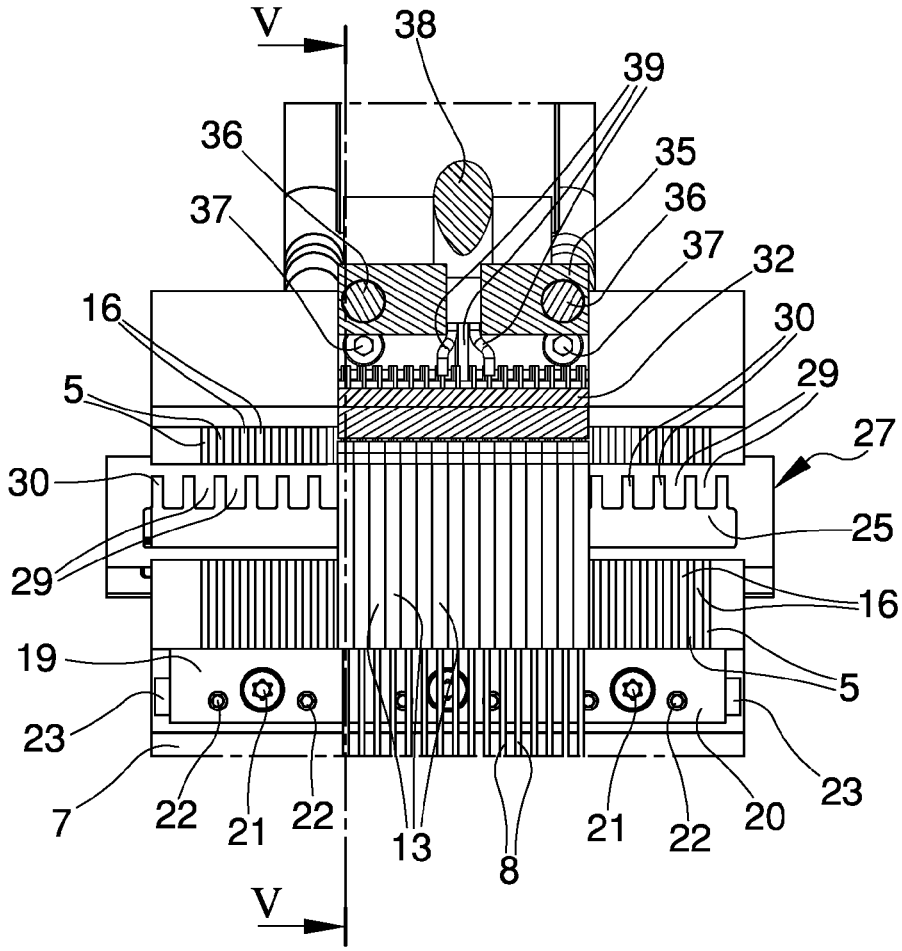
FIG. 4 shows a sectioned view along lines IV-IV of FIG. 3.
Figure 4A:
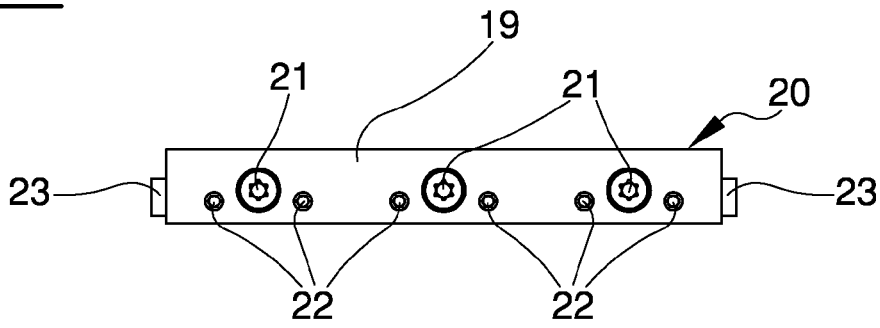
Figure 12:
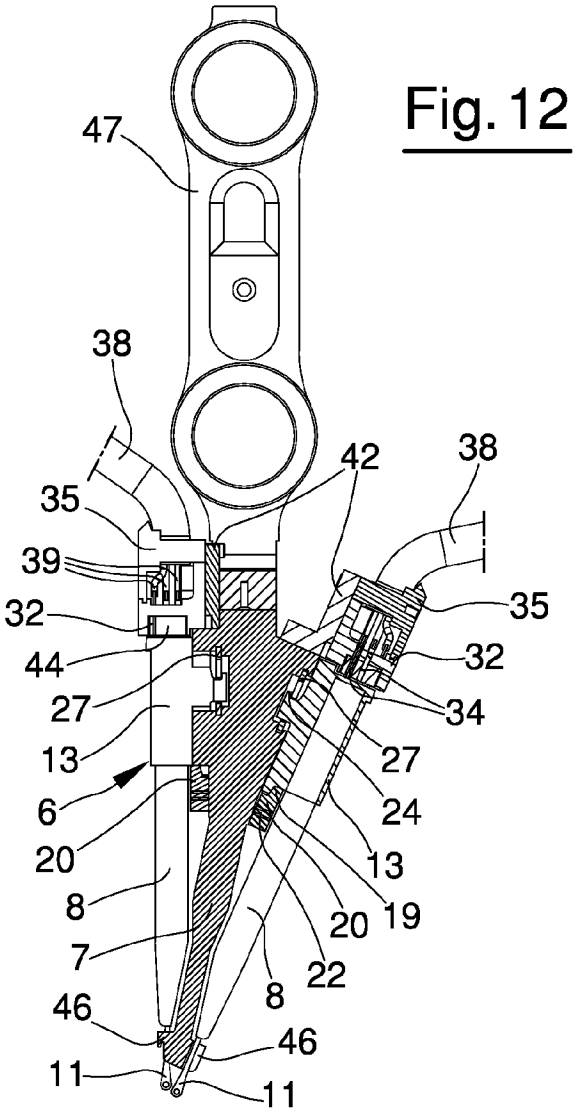
Figure 11:
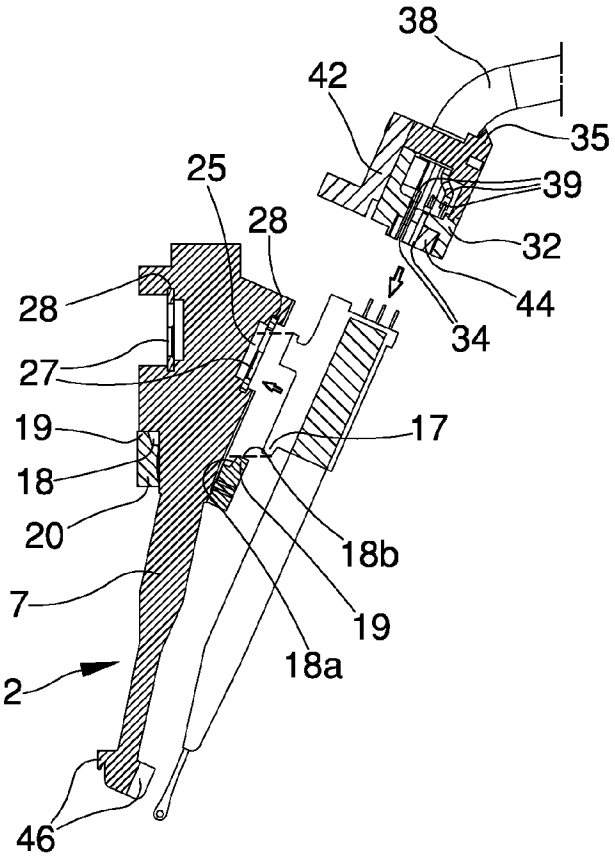
Figure 10:
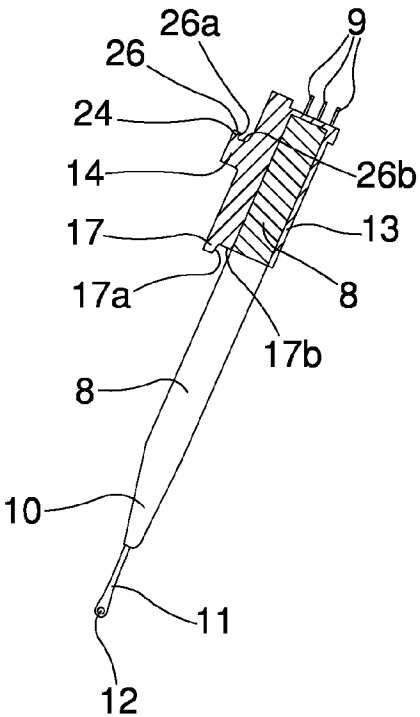
Figure 14:
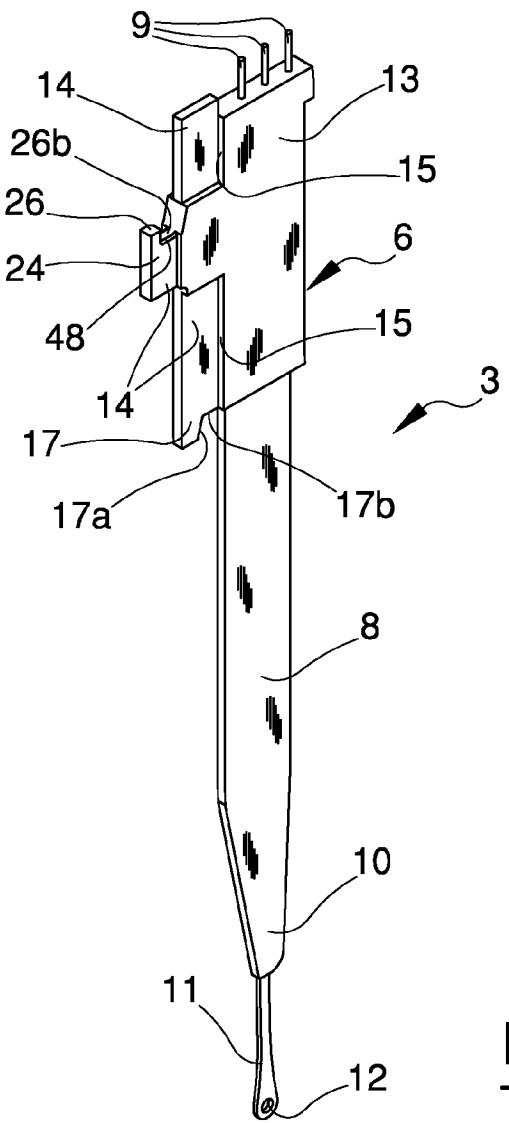
Figure 13:
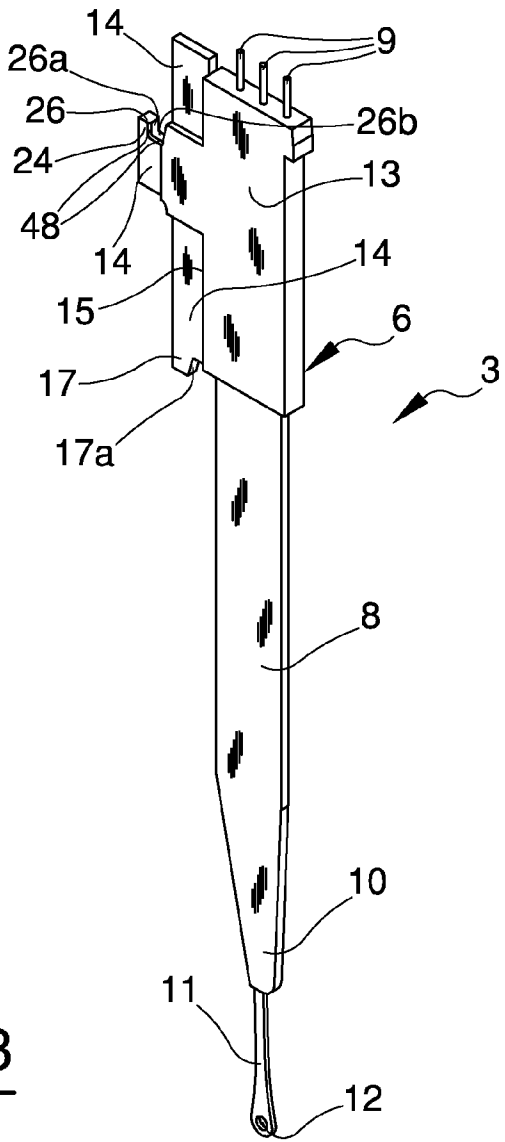
Figure 15:
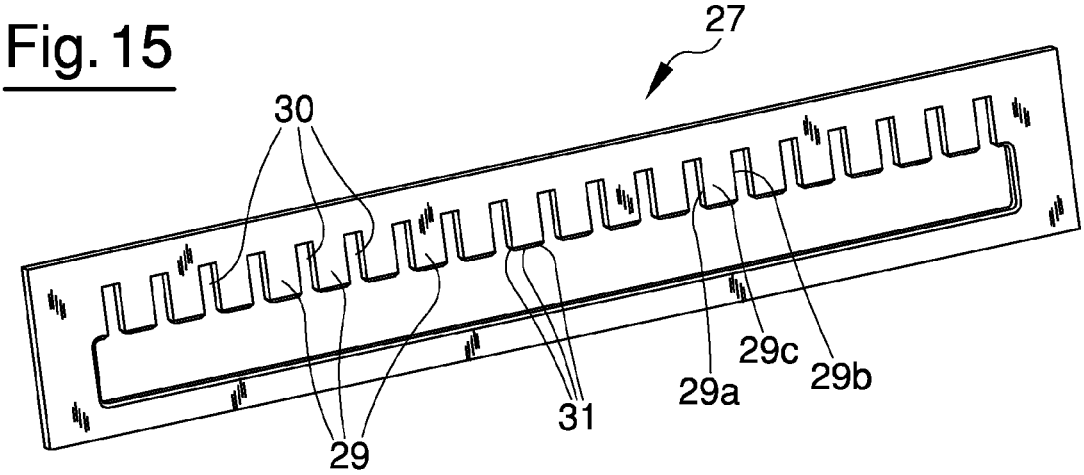
Figure 16:
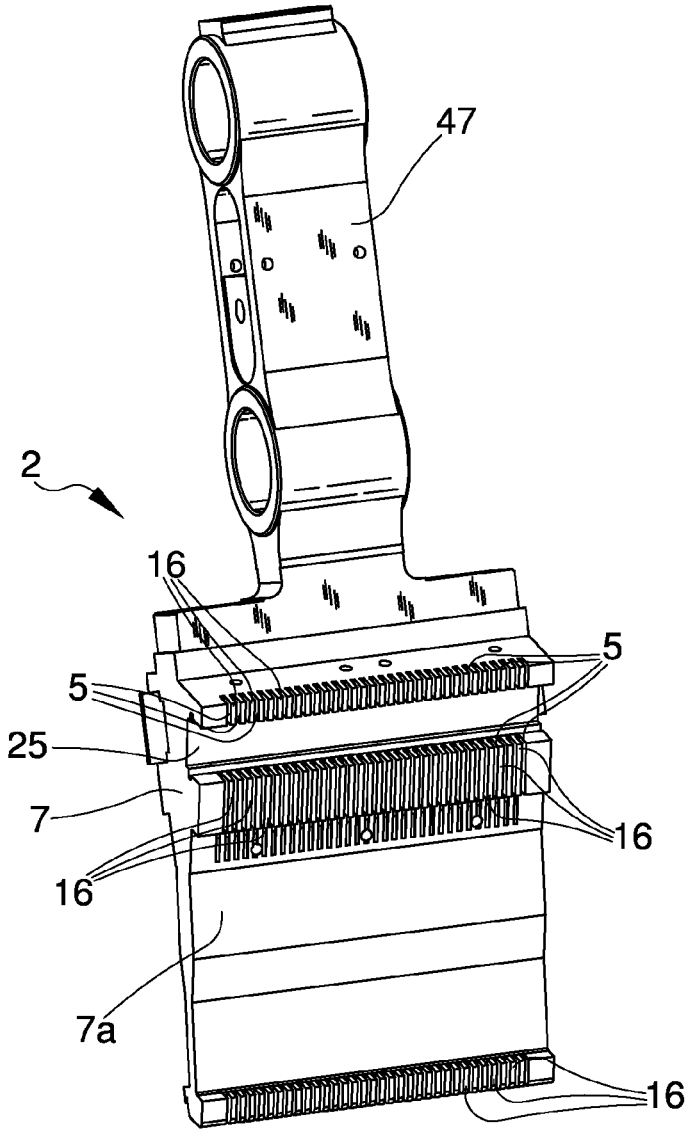

FIG. 4*a* shows a holding element separated from the other parts of FIG. 4;

FIG. 5 shows a sectioned view along lines V-V of FIG. 4;

FIGS. 6, 6*a*, 6*b* show three distinct operating positions of the blocking element of FIG. 2 with respect to a rest portion of piezoelectric actuators;

FIG. 7 is a view similar to the one of FIG. 3, showing an actuator and a connection device separated from the other parts of FIG. 3;

FIG. 8 is a view similar to the one of FIG. 3, showing an actuator separated from the other parts of FIG. 3;

FIG. 9 is another view similar to the one of FIG. 3, showing with broken lines some hidden parts;

FIG. 9*a* is a magnified view of a part of FIG. 9;

FIG. 9*b* is a top view of a piezoelectric element near a plurality of housing seats;

FIGS. 10, 11 and 12 are sectioned view of the device for jacquard selection and show three sequential mounting positions of a piezoelectric actuator on a jacquard bar;

FIGS. 13 and 14 are two perspective views of a piezoelectric actuator;

FIG. 15 is a perspective view of a blocking element, seen from the inside of the supporting body in mounting position;

FIG. 16 shows a perspective view of the jacquard bar of FIG. 1.

Referring to the aforesaid figures, a warp knitting machine (not shown since of per se known type) comprises at least one device 1 for jacquard selection according to the present invention. The device 1 for jacquard selection comprises at least one jacquard thread-guide bar 2 for each needle bed of the textile machine, a plurality of piezoelectric actuators 3 and a plurality of connection devices 4. The jacquard thread-guide bar 2 comprises a supporting body 7 provided with a plurality of housing seats 5 configured and predisposed so as to engage each removably a mounting body 6 of a single actuator for thread-guides and carry out an individual, removable mounting of the single actuator onto said supporting body 7. The supporting body 7 of the jacquard bar comprises a housing seat 5 for each piezoelectric actuator 3 to be housed in the bar, in a predefined number. The housing seats 5 extend perpendicularly to the main longitudinal extension of the bar and are preferably obtained by making cuts or grooves or by tooling in the supporting body 7. Preferably, the supporting body 7 is a main structural bearing part of the jacquard thread-guide bar. The bar 2 further comprises at least one mounting portion 47 by means of which it is mounted onto the textile machine. For reasons of simplicity, the figures show an exemplary bar 2 having a limited extension and one mounting portion 47 only, whereas—as is known—real bars are much longer and are generally associated with a plurality of mounting portions. Anyhow, the present description applies in the same way to bars 2 of any practical length. The supporting body 7 can be made e.g. of aluminum or suitable metal alloy. The supporting body 7 of the bar is provided with a front face 7*a* and with a rear face 7*b* extending in respective directions parallel to the main longitudinal extension of said supporting body 7. Preferably, the front face 7*a* and the rear face 7*b* are provided each with a corresponding plurality of housing seats 5. The housing seats 5 of the front face 7*a* are offset with respect to the housing seats 5 of the rear face of a needle shed, so as to be able to lie on even and odd needles, respectively, of the needle bed of the textile machine.

In an alternative embodiment, not shown, two jacquard thread-guide bars could be provided for each needle bed, a bar carrying the housing seats 5 for the piezoelectric actuators 3 operating on even needles and another bar carrying the housing seats 5 for the piezoelectric actuators 3 operating on odd needles of the needle bed.

The piezoelectric actuator 3 for jacquard thread-guide bars 2 of warp knitting textile machines comprises a piezoelectric body 8, a plurality of interface electric contacts 9 operatively connected to the piezoelectric body 8, a connecting portion 10 apt to interface with a thread-guide portion 11, and at least one mounting body 6 singularly dedicated to the piezoelectric actuator 3 and singularly coupled with the piezoelectric body 8. Advantageously, a single piezoelectric body 8 is mounted onto the mounting body 6. "Mounted onto the mounting body" means both that a portion of the piezoelectric body 8 is inserted into the mounting body 6, and alternatively that a portion of the piezoelectric body 8 is fastened outside said mounting body 6. Mounting occurs for instance by inserting a partial portion of the piezoelectric body 8 into the mounting body 6. In an alternative embodiment, mounting can take place by connecting a partial portion of the piezoelectric body 8 onto an outer surface of the mounting body 6. Piezoelectric body 8 means a complete piezoelectric or piezoceramic sheet, which can execute the bending movements required for the operation of a single piezoelectric actuator 3. For instance, the piezoelectric body 8 can comprise a sheet on whose two opposed faces two respective piezoceramic layers are provided, acting as capacitors piloted so as to cause the sheet to bend in a respective direction. Only the piezoelectric body 8 of the corresponding piezoelectric actuator 3 and no other complete piezoelectric body 8 (i.e. belonging to the other piezoelectric actuators 3) is mounted onto the mounting body 6 of each piezoelectric actuator 3, i.e. with a portion inserted into the mounting body 6 or applied outside the latter. The thread-guide portion 11 or thread-guide (e.g. made with a steel tip) is provided with a through opening 12 guiding a thread and is mounted onto the connecting portion 10 of the actuator, in the lower part of the actuator. In the present disclosure the term piezoelectric includes also the term piezoceramic. The thread-guide portion is designed to guide the weaving thread both for the movements (horizontal shifts) imparted by the piezoelectric sheet by bending, and for the movements generated by the jacquard bar holding the piezoelectric elements in its shog movement (longitudinal shift with respect to the needle bed). The thread-guide portion is mobile at least between two extreme positions defined by stops 46 defined on the supporting body 7 of the jacquard bar.

The electrical connection of the piezoelectric actuators 3 to the control/piloting system of the textile machine (electric control elements) consists of the electric contacts 9 or pins protruding from the piezoelectric body 8 or piezoelectric sheet with which they are integrated and made integral e.g. by inner weldings, and projecting from the mounting body 6, e.g. moulded in polymers or other plastic material, which insulates, protects and fixes such pins so as to make them robust and reliable. Advantageously, the upper part of the piezoelectric body 8 or piezoelectric sheet is embedded in the mounting body 6. Preferably, three interface electric contacts 9 are provided, protruding from a longitudinal end of the mounting body 6 parallel to the longitudinal extension of the piezoelectric body 8. The mounting body 6 is configured and predisposed so as to be able to be removably engaged into a housing seat 5 of the supporting body 7 of the jacquard bar and carry out an individual, removable mounting of the piezoelectric actuator 3 onto the supporting body 7. The piezoelectric actuators 3 can thus be inserted and taken out one by one and are perfectly interchangeable. Advantageously, the mounting body 6 is configured and predisposed so as to be slidingly engageable in a guided manner into the respective housing seat 5 of the supporting body 7, between a mounting position (shown in FIG. 12) and a disengaged position (shown in FIG. 11). The housing seats 5 are configured and predisposed so as to guide the sliding of the mounting body 6 of the actuators, between the mounting position and the disengaged position. Furthermore, the mounting body 6 protrudes transversally to the longitudinal extension of the piezoelectric body 8 into a lying plane of the piezoelectric body 8. Advantageously, the mounting body 6 extends longitudinally along at least one part of the longitudinal extension of the piezoelectric body 8. The mounting body 6 comprises at least one bearing portion 13 on, and preferably in which a part of the piezoelectric body 8 is housed. The bearing portion 13 can be made for instance of plastic material. Preferably, the bearing portion 13 of the mounting body 6 has a thickness basically corresponding to the shed of the housing seats 5 in the supporting body 7, so that a plurality of actuators mounted into a corresponding plurality of housing seats 5 have their bearing portions adjacent to one another and basically in contact with one another, defining on the outer side a basically continuous surface, as can be seen in FIGS. 1, 2 and 4. Advantageously, on the ends of the bar 2 the mounting bodies 6 can be retained by suitable mechanical stops (not shown since of per se known type).

The mounting body 6 further comprises at least one inserting portion 14 which can be slidingly engaged and guided into the respective housing seat 5 of the supporting body 7. The inserting portion 14 is advantageously thinned, with a thickness corresponding to the width of the housing seat 5 in which the inserting portion 14 is configured so as to be inserted, smaller than the corresponding thickness of the bearing portion 13. The inserting portion 14 gets perfectly into the cleft of the bar, determining the position thereof without error. The bearing portion 13 of the mounting body 6 is provided with a plurality of rest areas or surfaces 15 apt to cooperate with corresponding prop areas 16 (defined on the edges of the housing seats 5) of the supporting body 7 with the actuator mounted onto the supporting body 7 and with the inserting portion 14 inserted into the housing seat 5. Preferably, the rest areas 15 are made on the connection points between the bearing portion 13 and the inserting portion 14, and are advantageously defined by a smaller thickness of the inserting portion 14 with respect to the bearing portion 13. Preferably, the inserting portion 14 comprises an insert or basically laminar element inserted into the bearing body.

Advantageously, the mounting body 6 comprises at least a first hooking portion 17 configured so as to cooperate with a holding seat 18 defined by a holding portion 19 of the supporting body 7. Preferably, the first hooking portion 17 is made on the inserting portion 14. Preferably, the first hooking portion 17 is provided with a surface 17*a* inclined with respect to the longitudinal extension of the piezoelectric body 8 and configured so as to cooperate with a corresponding inclined surface 18*a* of the holding portion 19 of the supporting body 7. The supporting body 7 of the jacquard thread-guide bar 2 further comprises near the housing seats 5, e.g. below these, at least one said holding portion 19 defining the holding seat 18 and configured so as to act upon the first hooking portion 17 of the mounting body 6 of the actuators, in order to keep the mounting body 6 of every actuator in contact with the supporting body 7 when the actuators are mounted on the bar 2. Preferably, the holding portion 19 defines said surface 18*a* inclined with respect to the direction of longitudinal development of the housing seats 5 for pushing the first hooking portion 17 of the mounting body 6 of the actuators towards the supporting body 7 when the actuators are mounted on the bar 2. The contact between the inclined surface 17*a* and the inclined surface 18*a* ensures a precise contact and coupling, without clearances, between the rest areas or surfaces 15 of the piezoelectric actuators 3 and the corresponding prop areas 16 (defined on the edges of the housing seats 5) of the supporting body 7. Preferably, the first hooking portion 17 is further provided with a rest surface 17*b* configured so as to rest on a corresponding prop surface 18*b* of the holding portion 19 of the supporting body 7. The contact between the rest surface 17*b* and the prop surface 18*b* defines precisely the vertical position of the piezoelectric actuator 3 defining an end stop for the inserting portion 14. The holding portion 19 adjusts the position of the thread-guide portion and ensures at the same time a controlled forced coupling of the inserting portion 14 with the bar. The holding portion 19 locates the piezoelectric actuators 3 correctly both in horizontal and in vertical direction, since it also works as a lower end stop for the sliding of the inserting portion 14 in the housing seat 5. Advantageously, the holding portion 19 comprises at least one holding element 20 fastened to the supporting body 7, e.g. made of metal.

Preferably, the holding portion 19 comprises the holding element 20 that can be mounted onto the supporting body 7, means 21 for mounting onto the supporting body 7, e.g. comprising mounting screws, fine-adjustment elements 22 for the position of the holding portion 19 with respect to the supporting body 7, and fastening means 23 to the supporting body 7 apt to fasten in an unremovable manner the holding element 20 onto the supporting body 7 after fine-adjusting the position of the holding element 20. The fine-adjustment elements 22 can be made up of adjusting grub screws inserted into holes of the holding portion 19 and apt to change, when actuated, the position of the holding seat 18 with respect to the supporting body 7, e.g. by deformation of the holding element 20. In particular, the adjustment can be made by mounting the holding element 20 onto the supporting body 7 through the mounting means 21 without completely fastening said holding element 20 (e.g. without fully tightening the mounting means 21), inserting some specimen piezoelectric actuators 3 only along the bar and adjusting the position of the holding seat 18 by means of the fine-adjustment elements 22 (exploiting the elasticity and deformation of the material which the holding element 20 is made of) so as to optimize the mounting of the actuators, then the mounting means 21 are fully tightened and the holding element 20 is fastened in an unremovable manner through the fastening means 23. The fastening means 23 to the body can be made up of a welding or other elements or devices apt to fasten, preferably in an unremovable manner, the holding element 20 onto the supporting body 7 after adjusting the position of the holding element 20. Advantageously, the mounting body 6 further comprises at least a second hooking portion 24 having a shape apt to be able to be removably engaged into a corresponding hooking seat 25 obtained in the housing seat 5 of the supporting body 7, Preferably, the second hooking portion 24 has a shape apt to get hooked into the corresponding hooking seat 25.

The mounting body 6 comprises on the hooking seat 25 a rest portion 26 configured so as to cooperate with a blocking element 27 of the supporting body 7 for keeping the second hooking portion 24 within the corresponding hooking seat. Preferably, the supporting body 7 further comprises, e.g. on each housing seat 5, said hooking seat 25 configured so as to house the second hooking portion 24 of the mounting body 6. Preferably, the hooking seat 25 is obtained by means of a groove of the supporting body 7. Advantageously, the bar further comprises said blocking element 27 (shown in detail in FIG. 15) mobile at least between a first operating position in which it is apt to act upon the rest portion 26 of the mounting body 6 for keeping the second hooking portion 24 within the hooking seat 25 and the actuator mounted onto the bar, and a second operating position in which it is apt not to act upon the rest portion 26 and enables the second hooking portion 24 to be taken out of the hooking seat 25 and the actuator to be removed from the bar. The blocking element 27 is removably mounted onto the supporting body 7 so as to move at least between the first and second operating position. Preferably, the blocking element 27 is slidingly mounted into a sliding seat 28 obtained in the supporting body 7 for shifting at least between the first and second operating position.

The blocking element 27 is provided with a plurality of holding projections 29 apt to act upon the rest portions 26 of the actuators, and with a plurality of recesses 30 alternated to the holding projections 29, apt to let the rest portions 26 freely move. The recesses 30 are advantageously provided, in the areas of initial contact with the rest portions 26 of the piezoelectric actuators 3, with suitable first guides or chamfers or connections 31 or other similar elements for simplifying the movement of the blocking element 27 and the correct positioning of said actuators in mounting position. Preferably, each rest portion 26 is provided with corresponding second guides or chamfers or connections 48 or other similar elements whose function is to simplify the movement of the blocking element 27 and the correct positioning of the rest portion 26 and thus of the piezoelectric actuator 3. As can be seen in FIG. 15, advantageously, the first guides 31 are provided at least on the side walls 29*a* and 29*b* and on the rear wall 29*c* of the holding projections 29 (rear wall refers to the one facing the supporting body 7), whereas they are not necessary on the outer wall the holding projections 29 (outer wall refers to the one facing the piezoelectric actuators 3). As can be seen in FIG. 13, advantageously, the second guides 48 are provided at least on the contact walls 26*a* and 26*b* of the rest portion 26, and thus in the embodiment disclosed on a vertical contact wall 26*a* and on a horizontal contact wall 26*b*. As shown in the detail of FIG. 9*a*, the contact between the side walls 29*a* and 29*b* and the horizontal contact wall 26*b*, simplified by the corresponding first guides 31 and second guides 48, ensures the blocking and correct vertical positioning of the piezoelectric actuator 3, pushing the rest surface 17*b* against the prop surface 18*b*, which surfaces define precisely the vertical position of the piezoelectric actuator 3. As shown again in FIG. 9*a*, the contact between the rear wall 29*c* and the vertical contact wall 26*a*, simplified by the corresponding first guides 31 and second guides 48, ensures the blocking and correct horizontal positioning of the piezoelectric actuator 3, pushing the rest areas 15 against the prop areas 16 and ensuring a precise, clearance-free coupling between such elements. Thus, the blocking of each piezoelectric actuator occurs in a safe and accurate manner.

Preferably, the blocking element 27 is mobile between at least three operating positions (shown in detail in FIGS. 6, 6*a* and 6*b*), a first operating position (FIG. 6) in which it is apt to act upon all the rest portions 26 of all the actuators mounted onto the supporting body 7 for keeping all the second hooking portions in their respective hooking seats, a second operating position (FIG. 6*a*) in which it is apt to act upon a first sub-group of rest portions 26 of a first sub-group of actuators mounted onto the supporting body 7 and not to act upon a second sub-group of rest portions 26 of a second sub-group of actuators mounted onto the supporting body 7, thus enabling the corresponding second hooking portions to be taken out of the corresponding hooking seats and the second group of actuators to be removed from the supporting body 7, and a third operating position (FIG. 6*b*) in which it is apt to act upon the second sub-group of rest portions 26 of the second sub-group of actuators mounted onto the supporting body 7 and not to act upon the first sub-group of rest portions 26 of the first sub-group of actuators mounted onto the supporting body 7, thus enabling the corresponding second hooking portions to be taken out of the corresponding hooking seats and the first sub-group of actuators to be removed from the supporting body 7.

In this case, the blocking element 27 is mounted in a sliding manner into a sliding seat 28 obtained in the supporting body 7, so as to shift at least between the first, second and third operating position. Preferably, the first sub-group of rest portions 26 and the second sub-group of rest portions 26 include all the rest portions 26 mounted onto the bar and are alternated to one another, the first sub-group comprising even rest portions 26 and the second sub-group comprising odd rest portions 26. Basically, the blocking element 27 can include a latch sliding in the sliding seat 28 of the supporting body 7, which is provided with holding projections 29, e.g. teeth, apt to act upon the rest portions 26 of the actuators so as to keep the actuators correctly mounted onto the bar.

The blocking element 27 in the first operating position blocks all the actuators in mounting position (FIG. 6), in the second operating position (FIG. 6*a*), e.g. offset of half a shed of the housing seats 5 with respect to the first operating position, it blocks even actuators only (which are on the holding projections 29) and lets odd actuators free to be inserted or taken out (which are on the recesses 30), whereas in the third operating position (FIG. 6*b*), e.g. offset of another half a shed with respect to the first operating position, it blocks odd actuators only and lets even actuators free to be inserted or taken out. During the insertion of the piezoelectric actuators 3 onto the jacquard bar, therefore, all even actuators and then all odd actuators should be inserted (or vice versa), then the blocking element 27 will be shifted to the first blocking position for all actuators. Anyhow, the blocking element 27 can be shifted in the sliding seat 28 both manually and with an automatic actuating mechanism (not shown in detail since it can be of any suitable known type). The blocking element 27 and the hooking seat 25 can be of any shape depending on the various needs. It is further provided for a connection device 4 for piezoelectric actuators 3 for jacquard bars of textile machines, comprising a bearing body 32, at least one interconnection terminal 33 with control means (not shown since of known type) of the textile machine, a plurality of interconnection elements 34 inserted into the bearing body 32, which can be electrically connected in a removable manner to a corresponding plurality of interface electric contacts 9 of a plurality of piezoelectric actuators 3, and at least one fastening portion 35 configured and predisposed so as to mount the bearing body 32 in a removable manner onto the supporting body 7 of the jacquard thread-guide bar 2. Advantageously, the connection device 4 is configured so as to be able to be mounted directly onto the jacquard thread-guide bar 2.

The connection device 4 can be mounted onto a plurality of actuators, and it is preferably provided for a plurality of connection devices 4 which can be mounted each onto a plurality of actuators, e.g. 16 actuators each. Advantageously, the fastening portion 35 can be an integral part of the bearing body 32 or alternatively it can further comprise a fastening body distinct from the bearing body 32, which can be removably mounted onto the supporting body 7, e.g. by means of first screws 36. Moreover, the fastening body can be removably mounted onto the bearing body 32, e.g. by means of further screws and/or it can be fastened to the bearing body 32 with resins or other suitable means, e.g. tongues or the like. The bearing body 32 can be fastened in its turn to the supporting body 7 by means of second screws 37. If the mounting body 6 and the fastening body are fastened one to the other in an unremovable manner, the fastening portion 35 can further comprise an auxiliary mounting body 42 onto which are fastened the bearing body 32 and the fastening body, the auxiliary mounting body being able to be removably mounted onto the supporting body 7, e.g. by means of third screws 43, and being placed between the supporting body 7 and the bearing and fastening bodies.

It is thus possible to remove the connection device 4 from the supporting body 7 simply by removing the auxiliary mounting body 42 from the supporting body 7, keeping bearing body 32, fastening body and auxiliary mounting body 42 joined together. The interconnection terminal 33 comprises at least one connection cable 38 and a plurality of connection wires 39 housed inside the connection cable 38. The interconnection terminal 33 can further comprise a removable connector 40 for a removable connection to the control means of the textile machine. The upper part of the cable can carry e.g. a male socket apt to fit into the female sockets of a connection to an interface board. Advantageously, the fastening body has at least one positioning opening or seat 41 apt to house a portion of the connection cable 38 for keeping the connection cable 38 in a predefined position with respect to the fastening body. Advantageously, the bearing body 32 and the fastening portion 35 are configured so as to be able to be mounted onto the supporting body 7 and to be electrically coupled with the plurality of piezoelectric actuators 3 so that said interconnection elements 34 are associated with the interface electric contacts 9 and that the remaining parts of the connection device 4 do not contact said piezoelectric actuators 3, either the mounting body 6 or other parts (as can be seen e.g. in FIGS. 5 and 9). Preferably, no other part of the connection device 4 is physically in contact with the piezoelectric actuators 3 and/or advantageously, the connection device 4 has no substantial holding mechanical interaction with the piezoelectric actuators 3. In a variant of embodiment, which is not shown in the accompanying figures, the connection device 4 can further comprise a working portion apt to act, with the connection device 4 on the jacquard thread-guide bar 2 in mounting position, upon the plurality of actuators mounted directly on the supporting body 7 of the bar 2 so as to keep said actuators in mounting position on the bar 2. In this case, the working portion can be defined by a lower surface of the bearing body 32 contacting the mounting body 6 of the piezoelectric actuators 3 in mounting position, so as to push downward said mounting body 6 and keep in mounting position on the bar 2. The working portion is apt to act upon the mounting body 6 of the actuators so as to keep said mounting body 6 inside a housing seat 5 of the supporting body 7 of the jacquard thread-guide bar 2 and in contact with a holding portion 19 of the jacquard thread-guide bar 2.

Referring again to the preferred embodiments, advantageously each of said interconnection elements 34 comprises a female connector, which can be removably connected to the male interface electric contacts 9, and it is connected to a corresponding connection wire 39 (e.g. by means of connection terminals of the connection wires 39 inserted into the female interconnection elements 34) carrying the control signals for the actuators to the interconnection terminal 33, and thus to a control board by means of connections to an interface board. Preferably, the female connectors are housed inside a secondary body 44 operatively inserted into the bearing body 32. The female connectors are made e.g. of copper and are preferably embedded into the secondary body 44 and permanently fastened thereto by means of glues or sealants, epoxy resins or the like. Advantageously, the connection devices 4 further comprises a filling seat, which can be the same as said positioning seat 41, e.g. defined between the bearing body 32 and the fastening portion 35 or inside the fastening portion 35, containing a connection between the interconnection elements 34 and the connection wires 39 and apt to be at least partially filled with a sealing material e.g. a resin. In order to avoid various problems involving the electrical connections between female connectors and connection wires 39, resin is poured e.g. through an enlarged hole for letting the cable through. Said resin will fill the whole underlying area containing the connection wires 39 and the female connectors, thus creating one block with the bearing body 32. The whole is insulated, protected against penetrating moisture etc., but in particular the poured resin prevents the connection wires 39 and the female connectors from moving or vibrating.

In a further variant of embodiment, which is not shown, the device can further comprise at least one pushing element 45 apt to act, with the connection device 4 on the jacquard thread-guide bar 2 in mounting position, upon the plurality of actuators so as to keep the latter in position against the jacquard thread-guide bar 2. If the device comprises said working portion, the pushing element is configured so as to exert onto the actuators a force acting in a direction transversal, preferably perpendicular, to the direction in which acts a force exerted onto the actuators by the working portion. The pushing element is of elastic type and is apt to bend when the connection device 4 is associated with each actuator so as to exert an elastic thrust onto the plurality of actuators for keeping them in position against the jacquard thread-guide bar 2 in mounting position. In all the cases described above, when removing the connection device 4 from the supporting body 7 and separating it from the electric contacts 9 of the actuators, after activating and shifting the blocking element 27 to the suitable position, the piezoelectric actuators 3 (either even or odd actuators depending on the position of the blocking element 27) connected to the removed connection device 4 are automatically released and disengaged, so that a failed actuator can be removed and replaced with a new and operating one. Then the blocking element 27 is shifted again to the blocking position for all the piezoelectric actuators 3 and the removed connection device 4 is mounted again, re-connecting it to the electric contacts 9 or pins of the actuators and fastening again the connection device 4 to the jacquard bar, and the system is reset. Furthermore, a method is described for mounting piezoelectric actuators 3 of jacquard thread-guide bars 2 for warp knitting machines, comprising at least the steps of removably and individually housing a plurality of piezoelectric actuators 3 in a corresponding plurality of housing seats 5 obtained on the supporting body 7 of a jacquard thread-guide bar 2; shifting a blocking element 27 movably engaged to the thread-guide bar 2 so as to keep the piezoelectric actuators 3 in mounting position on the thread-guide bar 2, and removably mounting a connection device 4 onto the supporting body 7, by coupling a plurality of connectors of the connection device 4 with a corresponding plurality of electric contacts 9 of said piezoelectric actuators 3, and by removably mounting a fastening portion 35 of the connection device 4 onto the supporting body 7.

The invention thus conceived can be subjected to several changes and variants, all of which fall within the scope of the inventive idea. In practice, any material or size can be used depending on the various needs. Moreover, all the details can be replaced by other technically equivalent elements.

The invention achieves important advantages. First of all, the invention is simple in structure, easy to implement and not too expensive. The invention enables to replace single piezoelectric actuators simply, rapidly and cheaply, without complex technical interventions or adjustments and without damaging un-replaced actuators. The invention further reduces downtime, problems involving maintenance and replacement of piezoelectric actuators and also reduces spare stocks required to ensure a continuous operation of the textile machine, since it is no longer necessary to stock modules with 16 actuators each but only a small number of individual actuators. Management and maintenance costs for a machine according to the invention are therefore considerably lower than in the prior art. Moreover, the mounting of the piezoelectric actuators is robust and reliable and ensures an accurate and continuous operation of the device for jacquard selection. Furthermore, the jacquard bar can be single and no longer double as in the previous ones equipped with modules, and it is compact, light and robust since it can house both the piezoelectric actuators designed to work on even needles and on the opposite side the piezoelectric actuators designed to work on odd needles. Moreover, traditional jacquard bars (remember, there are two of them, one for even needles, the other for odd needles) share the same shog movement generated by two twin cams, whereas a jacquard bar according to the invention eliminates completely any possibility of error during movement (offsets between the two bars) since it is shifted by one cam and/or motor. The fact of having one cam or one motor only, with its control (e.g. optical lines) and actuation (drives) elements instead of two enables to reduce costs and to simplify the machine structure. The fact that the bar is mechanically cut on both sides with vertical clefts apt to house the actuators gives such a bar a very high accuracy and actually eliminates any possible horizontal adjustment on the position of the single actuators. Since each cleft houses one actuator, they have one position, without horizontal or vertical adjustments. Therefore, the actuator can be replaced even by non-specialized personnel without errors, eliminating all interventions involving adapting the modules, aligning and matching the needles and adjusting as are typical of the prior art, both when mounting the actuators onto the bar and during replacement.

The invention claimed is:

1. Connection device for piezoelectric actuators of jacquard bars of knitting machines, comprising a bearing body, a plurality of interconnection elements inserted into said bearing body and which can be removably connected to a corresponding plurality of interface electric contacts of a plurality of piezoelectric actuators, at least one interconnection terminal for interconnecting said interconnection elements to control means of a knitting machine, and at least one fastening portion configured and predisposed for removably mounting the bearing body to a supporting body of a jacquard thread-guide bar.

2. The connection device according to claim 1, wherein each of said interconnection elements comprises a female connector connected to a corresponding connection wire apt to transmit the control signals for said piezoelectric actuators from said interconnection terminal.

3. The connection device according to claim 1, wherein said fastening portion comprises at least one fastening body distinct from said bearing body, which can be removably mounted onto said bearing body.

4. The connection device according to claim 1, wherein said interconnection terminal comprises at least one connection cable and a plurality of connection wires housed within said connection cable.

5. The connection device according to claim 1, wherein said interconnection terminal comprises a removable connector.

6. The connection device according to claim 1, wherein said bearing body and said fastening portion are configured for being able to be mounted onto said supporting body and be electrically coupled with said plurality of piezoelectric actuators so that said interconnection elements are connected to the interface electric contacts and that the remaining parts of the connection device do not get in contact with said piezoelectric actuators.

7. The connection device according to claim 1, wherein it further comprises a filling seat within which there is a junction between the interconnection elements and connection wires and which is filled up at least partially with a sealant.

8. The connection device according to claim 1, wherein said fastening portion has at least one positioning seat apt to house a portion of a connection cable for keeping said connection cable in a pre-defined position with respect to said fastening portion.

9. A device for jacquard selection in warp knitting machines, comprising at least:

one jacquard thread-guide bar comprising a supporting body provided with a plurality of housing seats configured and predisposed for engaging each removably and singularly a corresponding mounting body of one of piezoelectric actuators for carrying out a removable mounting of said one of said piezoelectric actuators onto the supporting body;

said plurality of piezoelectric actuators comprising each a single mounting body to which one single piezoelectric body is mounted, each mounting body being engaged into a corresponding seat of said housing seats in an individually removable manner; and at least one connection device comprising a bearing body, a plurality of interconnection elements inserted into said bearing body and removably connected to a corresponding plurality of interface electric contacts of said plurality of piezoelectric actuators, at least one interconnection terminal for interconnecting said interconnection elements to control means of a knitting machine, and at least one fastening portion configured and predisposed for removably mounting the bearing body to said supporting body of said jacquard thread-guide bar, said connection device being removably mounted onto said supporting body of said jacquard thread-guide bar and removably connected to said plurality of piezoelectric actuators and said bearing body being distinct from said supporting body.

10. The device for jacquard selection according to claim 9, wherein said connection device is mounted directly onto said jacquard thread-guide bar.

11. The device for jacquard selection according to claim 9, wherein each of said interconnection elements comprises a female connector connected to a corresponding connection wire apt to transmit the control signals for said piezoelectric actuators from said interconnection terminal and each of said interface electric contacts is a pin.

12. The device for jacquard selection according to claim 9, wherein said fastening portion is an integral part of said bearing body or alternatively said fastening portion comprises a fastening body distinct from said bearing body and removably mounted onto, or fastened to, said bearing body.

13. The device for jacquard selection according to claim 9, wherein said fastening portion is an integral part of said bearing body and said bearing body is configured for being fastened to said supporting body by means of screws.

14. The connection device according to claim 2, wherein said interconnection elements further comprise a plurality of male connectors, operatively interposed between the plurality of female connectors and the connection wires.

15. The connection device according to claim 1, wherein said fastening portion is an integral part of said bearing body or alternatively said fastening portion comprises a fastening body distinct from said bearing body and removably mounted onto, or fastened to, said bearing body.

16. The connection device according to claim 1, wherein said bearing body is configured for being fastened to said supporting body by means of screws.

17. The connection device according to claim 1, wherein said fastening portion is an integral part of said bearing body and said bearing body is configured for being fastened to said supporting body by means of screws.

18. An assembly comprising a connection device for piezoelectric actuators of jacquard bars of knitting machines and a plurality of piezoelectric actuators, wherein the connection device comprises a bearing body, a plurality of interconnection elements inserted into said bearing body and removably connected to a corresponding plurality of interface electric contacts of said plurality of piezoelectric actuators, at least one interconnection terminal for interconnecting said interconnection elements to control means of a knitting machine, and at least one fastening portion configured and predisposed for removably mounting the bearing body to a supporting body of a jacquard thread-guide bar.

19. The assembly according to claim 18, wherein each of said interconnection elements comprises a female connector connected to a corresponding connection wire apt to transmit the control signals for said piezoelectric actuators from said interconnection terminal and each of said interface electric contacts is a pin.

20. The assembly according to claim 18, wherein said fastening portion is an integral part of said bearing body or alternatively said fastening portion comprises a fastening body distinct from said bearing body and removably mounted onto, or fastened to, said bearing body.

21. The assembly according to claim 18, wherein said fastening portion is an integral part of said bearing body and said bearing body is configured for being fastened to said supporting body by means of screws.

* * * * *